US005577470A

United States Patent [19]

Leydorf, Jr. et al.

[11] Patent Number: 5,577,470

[45] Date of Patent: Nov. 26, 1996

[54] VALVE SYSTEM FOR INTERNAL COMBUSTION ENGINE

[75] Inventors: George F. Leydorf, Jr., Birmingham; Michael J. Schrader, Belleville, both of Mich.

[73] Assignee: Ford Motor Company, Dearborn, Mich.

[21] Appl. No.: 554,019

[22] Filed: Nov. 6, 1995

[51] Int. Cl.[6] ..... F01L 1/18; F01M 9/10

[52] U.S. Cl. ..... 123/90.36; 123/90.39; 123/193.5

[58] Field of Search ..... 123/90.33, 90.36, 123/90.39, 90.4, 90.41, 90.44, 193.3, 193.5

[56] References Cited

U.S. PATENT DOCUMENTS

| | | | |
|---|---|---|---|
| 1,871,623 | 8/1932 | Le Fevre | 123/90.33 |
| 2,865,351 | 12/1958 | Mitchell | 123/90.36 |
| 3,150,648 | 9/1964 | Gropp | 123/90.39 |
| 3,251,350 | 5/1966 | Thompson | 123/90.41 |
| 4,086,887 | 5/1978 | Schoonover et al. | 123/90.39 |
| 4,393,820 | 7/1983 | Maki et al. | 123/90.41 |
| 4,491,099 | 1/1985 | Bonvallet | 123/90.44 |
| 4,537,166 | 8/1985 | Kimura et al. | 123/90.36 |
| 4,617,883 | 10/1986 | Okuyama et al. | 123/90.44 |
| 4,628,875 | 12/1986 | Wells et al. | 123/90.36 |
| 4,655,177 | 4/1987 | Wells et al. | 123/90.36 |
| 4,718,379 | 1/1988 | Clark | 123/90.39 |
| 4,724,804 | 2/1988 | Wirth | 123/90.39 |
| 5,095,861 | 3/1992 | Dove, Jr. | 123/90.39 |
| 5,339,778 | 8/1994 | Reckzugel et al. | 123/90.39 |
| 5,433,178 | 7/1995 | Urmaza | 123/90.41 |

FOREIGN PATENT DOCUMENTS 649628 10/1962 Canada .

*Primary Examiner*—Weilun Lo
*Attorney, Agent, or Firm*—Jerome R. Drouillard

[57] ABSTRACT

A valve system for an internal combustion engine with multiple intake and exhaust valves driven by rocker arms includes a fixed, nonrotatable, rocker shaft for mounting the rocker arms, with the rocker shaft being mounted in saddles formed in an outer surface of the cylinder head. Each of the saddles has opposing pads forming a generally semicircular mount for the rocker shaft, with the mounting pads being offset in opposite directions such that the rocker shaft and the pads make line contact in a region proximate the arc midpoint of each pad.

11 Claims, 2 Drawing Sheets

VALVE SYSTEM FOR INTERNAL COMBUSTION ENGINE

BACKGROUND OF THE INVENTION

1. Technical Field

The present invention relates to a valve system for an internal combustion engine having nonrotatable rocker shafts for mounting rocker arms or finger followers which actuate intake and exhaust popper valves.

2. Description of Prior Art

In designing a valve system or valve train mechanism for an internal combustion engine which is expected to operated at high engine speed, it is necessary to limit component deflections at the maximum rated speed. As an approximation, limiting values could comprise 0.0015 inches deflection for a rocker arm, measured at the valve tip, and 0.00075 inches of deflection of the rocker shaft, measured at the location of the rocker arm. In engines using cylindrical rocker shafts, a typical way of mounting the shafts involves placing the shaft as a slip-fit in a round mounting bore formed in the cylinder head. This causes problems because tolerances permit movement of the rocker shaft of the magnitude recited above. This is undesirable because, as noted above, any loss of stiffness due to wobble or movement of the parts of the valve system will reduce the maximum satisfactory operating speed of the valve system. The present invention mitigates this problem because it provides support for a rocker shaft at three circumferential locations which are approximately equally spaced. The rocker shaft is supported with a robustness which is essentially independent of dimensional tolerances of the rocker shaft and the mounting saddles. In conventional saddle mounting systems in which a nonrotatable rocker shaft is placed in a semicircular saddle, the diameter of the saddle must be sufficient so that the shaft neither touches solely at the bottom of the saddle, in which case the shaft would be free to rock back and forth in the presence of side loading imposed by the rocker arms and valve springs. Also, the shaft should not be pinched between the upper edges of the saddle because this will produce unwanted stresses in both the saddle and the shaft. As a result, it is exceedingly difficult to produce a semicircular saddle and shaft having appropriately sized diameters during mass production of engines. This manufacturing problem, which is present in other systems, is solved by the present invention.

SUMMARY OF THE INVENTION

A valve system for an internal combustion engine includes a plurality of intake and exhaust poppet valves, a plurality of rocker arms for actuating the poppet valves, a cylinder head having the popper valves mounted therein, at least one fixed rocker shaft for mounting the rocker arms, with the rocker shaft having a cylindrical outer surface, and a plurality of saddles formed in an outer surface of the cylinder head for nonrotatably mounting the rocker shaft, with the saddles each having opposing arcuate pads which form a generally semicircular mount for the rocker shaft. Each of the mounting pads is concave and has a radius of curvature which is greater than the outside radius of curvature of the rocker shaft, with the center of the radius of curvature of each of the pads being offset in opposite directions from the centerline of the shaft such that the shaft and the pads make line contact in a region proximate to the arc midpoint of each pad. The arcuate pads preferably have a circular form generated by an invariant radius of curvature.

According to yet another aspect of the present invention, a lubricant supply subsystem comprises a lubricant passage extending from a lubricant supply system of the engine through the concave surface of at least one of the pads at the location of the line contact between the pad and the rocker shaft, with the lubricant then passing through a port formed in the rocker shaft and into an inner volume of the rocker shaft.

According to a preferred embodiment, the rocker shaft comprises a hollow cylinder having an axially extending interior passage for conveying lubricating oil to the rocker arms.

DETAILED DESCRIPTION OF PREFERRED EMBODIMENTS

Figure 1:
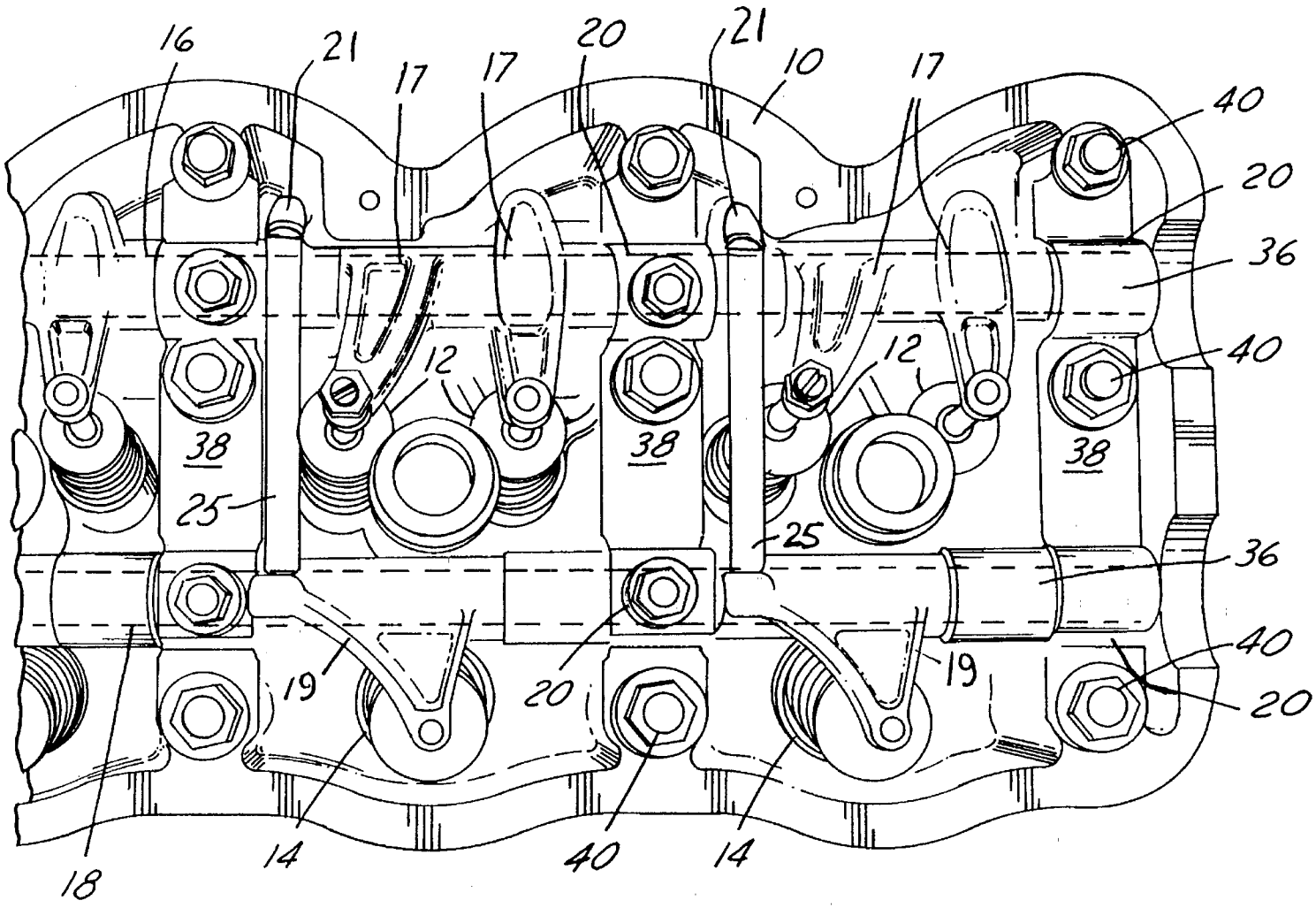
FIG. 1 is a perspective view of a cylinder head having a valve system according to the present invention.

As shown in FIG. 1, a valve system for an internal combustion engine includes a multitude of components which are attached to cylinder head 10. In this case, each cylinder is serviced by two intake valves 12 and a single exhaust poppet valve 14. Each pair of intake valves 12 for a given cylinder is actuated by a single intake rocker arm 17, which is bifurcated and which contacts both of intake valves 12 for a single cylinder. Each of intake rocker arms 17 is driven in conventional fashion by means of a pushrod (not shown) which extends up from a camshaft located in a lower part of the engine. Intake rocker arms 17 are mounted upon intake rocker shaft 16, which is shown with greater clarity in FIG. 2.

Exhaust valves 14 are driven by exhaust rocker arms 19, which are actuated by means of secondary pushrods 25 which extend across the top of the cylinder head between exhaust rocker arm 19 and intermediate rocker arm 21. The sole function of intermediate rocker arm 21 is to act as a bellcrank between secondary pushrod 25 and a primary pushrod (not shown) extending between intermediate rocker arm 21 and the camshaft.

As is readily understood by those skilled in the art, the present system causes considerable side loading on both intake rocker shaft 16 and exhaust rocker shaft 18. As noted above, it is necessary to maintain precise mounting geometry of both of the rocker shafts so as to maintain precision operation of both intake and exhaust valves, particularly during higher engine speeds. This precise geometry is promoted by the structure in FIG. 2. A plurality of saddles 20 is formed in the upper surface of cylinder head 10. Saddles 20 provide a means for nonrotatably mounting intake rocker shaft 16 and exhaust rocker shaft 18. Each saddle has a pair of arcuate pads 22 and 24. Arcuate pad 22 has a concave surface 22*a*, whereas arcuate pad 24 has a concave surface 24*a*. Both of these concave surfaces may be formed by a longitudinal pass of a forming tool such as a milling cutter or other type of cutter capable of producing a circular surface. Arcuate pad 22 has a radius $R_{22}$ and arcuate pad 24 has a radius $R_{24}$. These radii of curvature are, in this case, equal, and both have a value greater than the outside radius of rocker shaft 16.

Figure 2:
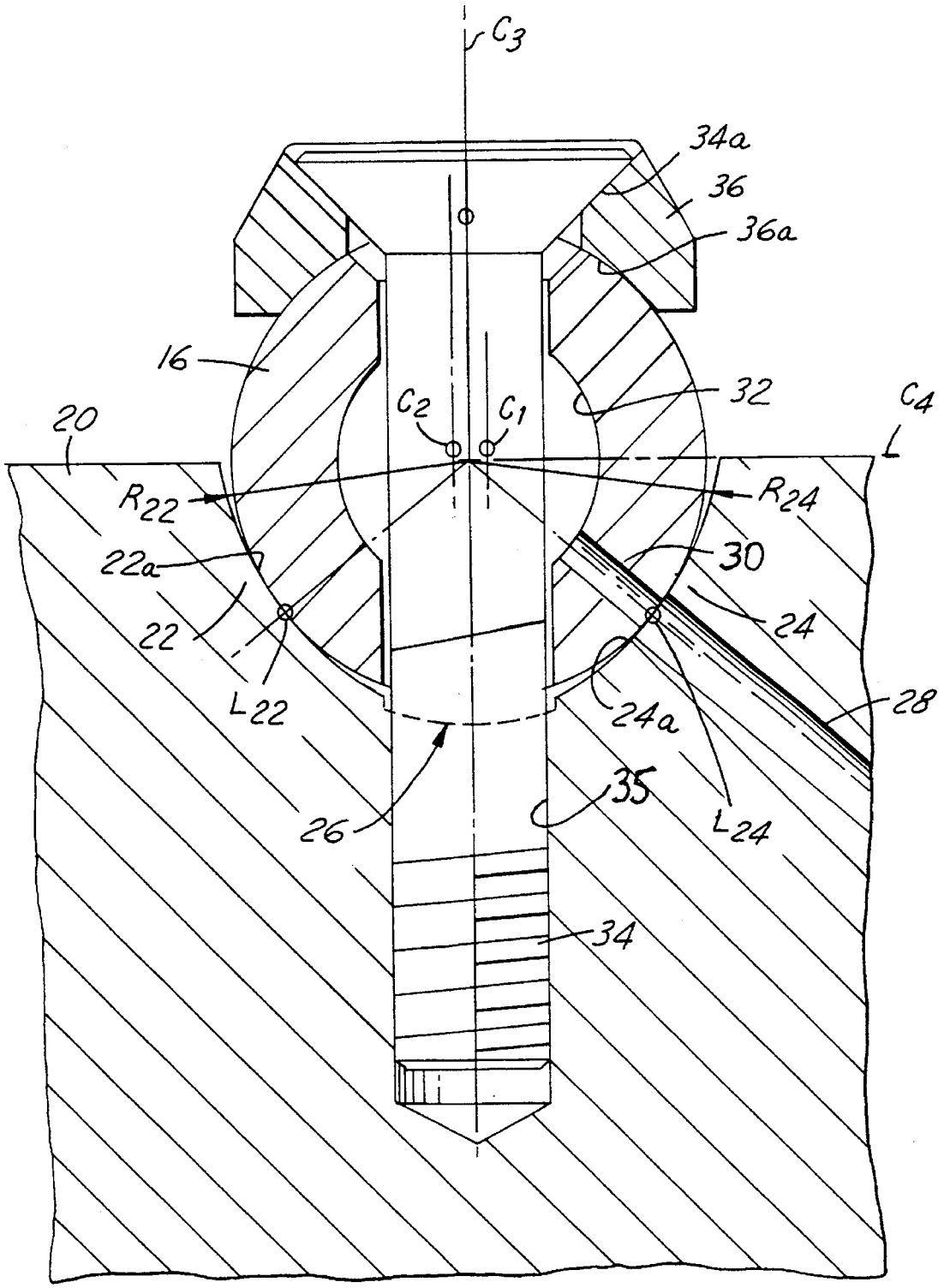
FIG. 2 is a partially schematic representation of a rocker shaft mounting system according to the present invention.

As seen in FIG. 2, center $C_1$ of arcuate pad 22 is offset from the center lines $C_3$ and $C_4$ of rocker shaft 16 such that the contact patch between the outer surface of rocker shaft 16 and concave surface 22*a* is a line contact occurring at location $L_{22}$ which is the arc midpoint of concave surface 22*a*. Similarly, center $C_2$ of arcuate surface 24*a* is offset in an opposite direction from the center line of shaft 16 to achieve the line contact labeled $L_{24}$. As is the case with $L_{22}$, line contact $L_{24}$ is situated 45° from the vertical centerline of rocker shaft 16. Because contact between saddle 20 and shaft 16 is two lines $L_{22}$ and $L_{24}$, situated at the arc midpoints of arcuate pads 22 and 24, shaft 16 may be reliably, repeatably, and robustly placed in its desired position—a position which may be maintained largely independent of manufacturing tolerance stackup. This obviates the problems encountered with other mounting systems in which engineers and engine builders attempted to keep the outside diameter of a shaft, such as shaft 16, closely matched to the inside diameter of a bed plate or saddle such as saddle 20. Such a scheme was often destined for failure because of the tendency for the shaft to either be positioned tightly against the bottom of the saddle or at the top edges of the saddle. With the rocker shaft at the bottom, the shaft would tend to rock in the saddle; when wedged at the top of the saddle, the rocker shaft and its fastening system could induce excessive stress in both the saddle and the rocker shaft itself.

Each of rocker shafts 16 and 18 are maintained in their respective saddles by means of retaining bolts 34 and clamps 36. Each of bolts 34 has a load bearing surface 34*a* in contact with clamp 36, which itself has an arcuate contact surface 36*a* providing contact with the outer surface of rocker shaft 16. Fastener 34 passes through relief groove 26, which is milled, of formed in any other acceptable manner, in the lower surface of saddle 20. The combination of the arcuate engagement of clamp 36 with shaft 16 as well as engagement of shaft 16 with arcuate surfaces 22*a* and 24*a* solidly mounts shaft 16 to cylinder head 10. Those skilled in the art will appreciate in view of this disclosure that the contact pattern between rocker shaft 16 and clamp 36 need be only a line contact on one side of fastener 34 in order to securely fasten the rocker shaft to saddles 20. Those skilled in the art will further appreciate, in view of this disclosure, that clamps 36 may be located precisely by bolts 34 by piloting clamps 36 upon the upper portions of the shanks of bolts 34. Clamps 36 not only maintain rocker shafts 16 in their saddles, but also provide thrust surfaces for maintaining the various rocker arms in their desired axial locations.

The present cylinder head advantageously uses bolt bosses 38, through which cylinder head bolts 40 pass, for the dual purpose of providing a place for saddles 20 along with threaded bores 35 for fasteners 34.

According to another aspect of the present invention, cylinder head lubricant passage 28 provides lubricant, in this case, engine oil, through port 30 formed in intake rocker shaft 16. After flowing through port 30, lubricant flows into bore 32, which forms the interior of rocker shaft 16. Lubricant is allowed to flow through bore 32 and then through suitably located outlet ports (not shown) so as to lubricate intake rocker arms 17. Exhaust rocker shaft 18 has a similar axially directed bore for the purpose of providing oil to exhaust rocker arms 19.

While the invention has been shown and described in its preferred embodiments, it will be clear to those skilled in the arts to which it pertains that many changes and modifications may be made thereto without departing from the scope of the invention. For example, the present invention may be employed with overhead camshaft engines having followers which are journaled to a common rocker shaft.

What is claimed is:

1. A valve system for an internal combustion engine, comprising:

a plurality of intake and exhaust poppet valves;

a plurality of rocker arms for actuating said poppet valves;

a cylinder head having said popper valves mounted therein;

at least one fixed rocker shaft for mounting said rocker arms, with said rocker shaft having a cylindrical outer surface; and a plurality of saddles formed in an outer surface of said cylinder head for nonrotatably mounting said rocker shaft, with said saddles each having opposing arcuate pads which form a generally semicircular mount for said rocker shaft, with said pads each being concave and having a radius of curvature which is greater than the outside radius of the rocker shaft, and with the center of the radius of curvature of each of the pads being offset in opposite directions from the center line of the shaft such that the shaft and the pads make a straight line contact in a region proximate the arc midpoint of each pad.

2. A valve system according to claim 1, wherein each of said arcuate pads has a circular form generated by an invariant radius of curvature.

3. A valve system according to claim 1, further comprising a lubricant supply subsystem comprising a lubricant passage extending from a lubricant supply system of the engine through the concave surface of at least one of said pads at the location of said line contact between the pad and the rocker shaft, and then through a port formed in the rocker shaft and into an inner volume of the rocker shaft.

4. A valve system according to claim 3, wherein said rocker shaft comprises a hollow cylinder having an axially extending interior passage for conveying lubricating oil to said rocker arms.

5. A valve system according to claim 1, wherein said saddles are incorporated into bosses through which bolts pass for retaining the cylinder head to a cylinder block of the engine.

6. A valve system according to claim 1, further comprising a plurality of fasteners, with each extending first through a clamp and then through said rocker shaft and into said saddles, with each of said clamps having an arcuate surface in contact with the outer surface of the rocker shaft such that the rocker shaft is clamped into contact with said saddles.

7. A valve system according to claim 6, wherein each of said clamps serves to axially locate at least one of said rocker arms.

8. A valve system for an internal combustion engine, comprising:

a plurality of intake and exhaust popper valves;

a plurality of rocker arms for actuating said poppet valves;

a cylinder head having said popper valves mounted therein;

at least one fixed rocker shaft for mounting said rocker arms, with said rocker shaft having a cylindrical outer surface and a cylindrical inner bore;

a plurality of saddles formed in an outer surface of said cylinder head for nonrotatably mounting said rocker shaft, with said saddles each having a base relief groove and opposing arcuate pads which, taken together, form a generally semicircular surface for mounting said rocker shaft, with said pads each being concave and having a radius of curvature which is greater than the outside radius of the rocker shaft, and with the center of the radius of curvature of each of the pads being offset from the center of the shaft in a different direction such that the shaft makes a line contact with the pads in regions lying approximately 45° from the outermost ends of the pads; and a plurality of fasteners, with each extending first through a clamp and then through said rocker shaft and into said saddles, with each of said clamps having an arcuate surface in contact with the outer surface of the rocker shaft, such that the rocker shaft is clamped into contact with said saddles.

9. A valve system according to claim 8, wherein each of said arcuate pads has a circular form generated by an invariant radius of curvature.

10. A valve system according to claim 8, further comprising an oil supply subsystem comprising at least one oil passage extending from a lubricant supply system of the engine through the concave surface of at least one of said pads at the location of said line contact between the pad and the rocker shaft, and then through a port formed in the rocker shaft and into the cylindrical inner bore of the rocker shaft.

11. A valve system according to claim 8, wherein said saddles are incorporated into bosses through which bolts pass for retaining the cylinder head to a cylinder block of the engine.

* * * * *